US011815927B1

(12) United States Patent
Qin

(10) Patent No.: US 11,815,927 B1
(45) Date of Patent: Nov. 14, 2023

(54) BANDGAP REFERENCE CIRCUIT AND CHIP

(71) Applicant: CHANGXIN MEMORY TECHNOLOGIES, INC., Hefei (CN)

(72) Inventor: Jianyong Qin, Hefei (CN)

(73) Assignee: CHANGXIN MEMORY TECHNOLOGIES, INC., Hefei (CN)

( * ) Notice: Subject to any disclaimer, the term of this patent is extended or adjusted under 35 U.S.C. 154(b) by 0 days.

(21) Appl. No.: 17/937,417

(22) Filed: Sep. 30, 2022

Related U.S. Application Data

(63) Continuation of application No. PCT/CN2022/098455, filed on Jun. 13, 2022.

(30) Foreign Application Priority Data

May 19, 2022 (CN) ..... 202210557879.4

(51) Int. Cl.
*G05F 3/30* (2006.01)
*G05F 1/575* (2006.01)

(52) U.S. Cl.
CPC ..... *G05F 1/575* (2013.01); *G05F 3/30* (2013.01)

(58) Field of Classification Search
None
See application file for complete search history.

(56) References Cited

U.S. PATENT DOCUMENTS 6,894,555 B2 * 5/2005 Liu ..... G05F 3/30 327/539
7,514,987 B2 * 4/2009 Lin ..... G05F 3/30 327/539
8,587,286 B2 * 11/2013 Inoue ..... G05F 3/16 323/281
8,994,356 B2 * 3/2015 Theoduloz ..... G05F 3/30 327/539

(Continued)

FOREIGN PATENT DOCUMENTS

CN 102004516 A 4/2011
CN 202383552 U 8/2012

(Continued)

OTHER PUBLICATIONS

Kuijk Karel E. "A precision reference voltage source" IEEE Journal of Solid-State Circuits, vol. SC-8, No. 3, Jun. 1973, p. 222-p. 226.

*Primary Examiner* — Thomas J. Hiltunen
(74) *Attorney, Agent, or Firm* — SYNCODA LLC; Feng Ma

(57) ABSTRACT

A bandgap reference circuit includes a feedback transistor, a reference setting circuit, an amplification circuit and an output transistor. A source of the feedback transistor is configured to connect to a first power supply, and a drain of the feedback transistor is configured to connect to a first node. The reference setting circuit includes a first bridge arm and a second bridge arm which are connected in parallel. An inverting input terminal of the amplification circuit is connected to the first bridge arm, and a non-inverting input (Continued)

terminal of the amplification circuit is connected to the second bridge arm. A gate of the output transistor is connected to an output terminal of the amplification circuit, and a source of the output transistor is connected to the first power supply.

16 Claims, 15 Drawing Sheets

(56) References Cited

U.S. PATENT DOCUMENTS

| | | | | |
|---|---|---|---|---|
| 9,213,353 | B2 * | 12/2015 | Siao | G05F 3/16 |
| 9,898,029 | B2 * | 2/2018 | Rasmus | G05F 3/242 |
| 10,310,528 | B1 * | 6/2019 | Elsayed | G05F 3/30 |
| 10,371,582 | B2 * | 8/2019 | Obayashi | G01K 7/01 |
| 11,262,783 | B2 * | 3/2022 | Chu | G05F 1/10 |
| 2007/0080740 | A1 * | 4/2007 | Berens | G05F 3/30 327/539 |
| 2011/0175593 | A1 * | 7/2011 | Ookuma | G05F 3/30 323/313 |

FOREIGN PATENT DOCUMENTS

| | | | |
|---|---|---|---|
| CN | 103677056 | A | 3/2014 |
| CN | 112859993 | A | 5/2021 |
| CN | 113359929 | A | 9/2021 |
| JP | H10124161 | A | 5/1998 |

* cited by examiner

BANDGAP REFERENCE CIRCUIT AND CHIP

CROSS-REFERENCE TO RELATED APPLICATIONS

This is a continuation of International Patent Application No. PCT/CN2022/098455 filed on Jun. 13, 2022, which claims priority to Chinese Patent Application No. 202210557879.4 filed on May 19, 2022. The disclosures of the above-referenced applications are hereby incorporated by reference in their entirety.

BACKGROUND

Bandgap reference circuit is a circuit used to provide a constant reference voltage or reference current which is not affected by temperature for the circuit. The bandgap reference circuit in some implementations has a relatively stable structure that can be used for a long time. In a case that the reference voltage or reference current that is required to be output is determined, it can be realized only by adjusting the component parameters in the common bandgap reference circuit. However, only adjusting the component parameters will limit the output driving ability of the bandgap reference circuit. In addition, there is room for improvement in the gain of the bandgap reference circuit.

It should be noted that the information disclosed in the above background section is only for enhancement of understanding of the background of the present disclosure. Therefore, the information may include information that does not constitute prior art known to those of ordinary skill in the art.

SUMMARY

The present disclosure relates to the field of integrated circuit technology, in particular to a bandgap reference circuit and a chip applied with the bandgap reference circuit.

An object of the present disclosure is to provide a bandgap reference circuit and a chip applied with the bandgap reference circuit, for improving output driving capability and gain of the bandgap reference circuit at least to a certain extent.

According to a first aspect of the present disclosure, a bandgap reference circuit is provided. The bandgap reference circuit includes a feedback transistor, a reference setting circuit, an amplification circuit and an output transistor. A source of the feedback transistor is configured to connect to a first power supply, and a drain of the feedback transistor is configured to connect to a first node. The reference setting circuit includes a first bridge arm and a second bridge arm which are connected in parallel. The first bridge arm includes a first resistance sub-circuit and a first voltage adjustment sub-circuit which are sequentially connected in series. The second bridge arm includes a second resistance sub-circuit, a third resistance sub-circuit and a second voltage adjustment sub-circuit which are sequentially connected in series. Both the first resistance sub-circuit and the second resistance sub-circuit are connected to the first node, a resistance value of the first resistance sub-circuit is equal to a resistance value of the second resistance sub-circuit, and both the first voltage adjustment sub-circuit and the second voltage adjustment sub-circuit are connected to a ground. An inverting input terminal of the amplification circuit is connected to the first bridge arm, a non-inverting input terminal of the amplification circuit is connected to the second bridge arm, and an output terminal of the amplification circuit is connected to a gate of the feedback transistor. A gate of the output transistor is connected to an output terminal of the amplification circuit, a source of the output transistor is connected to the first power supply, and a drain of the output transistor is taken as an output terminal of the bandgap reference circuit.

According to a second aspect of the present disclosure, a chip is provided. The chip includes a bandgap reference circuit as described in any one embodiment.

It should be understood that the above general description and the following detailed description are exemplary and explanatory only and are not intended to limit the present disclosure.

BRIEF DESCRIPTION OF THE DRAWINGS

The accompanying drawings which are incorporated in and constitute a part of the description illustrate embodiments consistent with the present disclosure and serve to explain the principles of the present disclosure together with the description. It will be apparent that the drawings described below are only some embodiments of the present disclosure, and other drawings may be obtained from them without creative effort for those of ordinary skill in the art.

DETAILED DESCRIPTION

Figure 1:
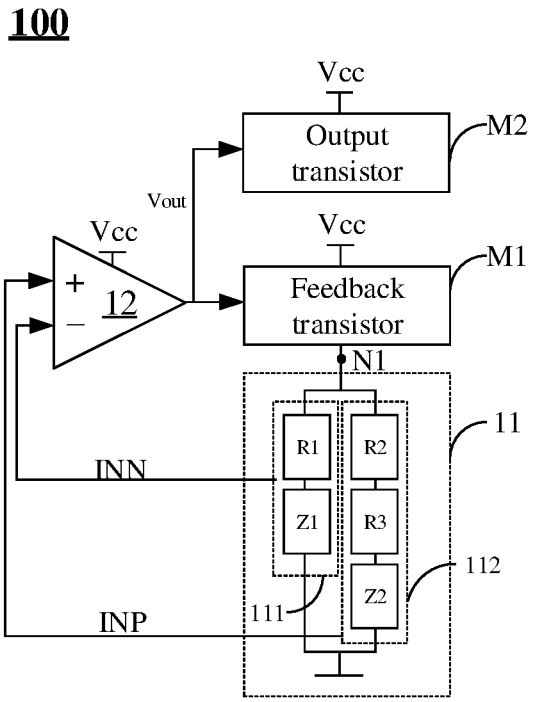
FIG. 1 is a schematic structural diagram of a bandgap reference circuit in some exemplary embodiments of the present disclosure.

Example embodiments will now be described more fully with reference to the accompanying drawings. However, example embodiments can be implemented in a variety of forms and should not be construed as being limited to the examples set forth herein. On the contrary, these embodiments are provided so that the present disclosure will be more comprehensive and complete and the idea of example embodiments will be fully communicated to those skilled in the art. The described features, structures or characteristics may be incorporated in one or more embodiments in any suitable manner. In the following description, many specific details are provided to give a full understanding of the embodiments of the present disclosure. However, those skilled in the art will appreciate that the technical solutions of the present disclosure may be practiced without one or more of the specific details described, or other methods, components, devices and steps and the like may be employed. In other situations, well-known technical solutions are not shown or described in detail to avoid presumptuous and obscuring aspects of the present disclosure.

Further, the drawings are only schematic illustrations of the present disclosure, and same reference numerals in the drawings denote the same or similar parts, thus repeated descriptions thereof will be omitted. Some of the block diagrams shown in the drawings are functional entities that do not necessarily correspond to physically or logically independent entities. The functional entities may be implemented in software, in one or more hardware circuits or integrated circuits, or in different networks and/or processor devices and/or microcontroller devices.

In a bandgap reference circuit provided by the embodiments of the present disclosure, a feedback transistor connected to the first power supply is set between the output terminal of the amplification circuit and the input terminal of the reference setting circuit, thus a current related to the output signal of the amplification circuit can be supplied to the reference setting circuit through the first power supply, instead of directly supplying the current to the reference setting circuit through the output terminal of the amplification circuit, thereby greater current is provided to the reference setting circuit and further improving the current driving capability of the bandgap reference circuit.

Exemplary embodiments of the present disclosure will be described in detail below with reference to the accompanying drawings.

FIG. 1 is a schematic structural diagram of a bandgap reference circuit in some exemplary embodiments of the present disclosure.

Referring to FIG. 1, the bandgap reference circuit 100 may include a feedback transistor M1, a reference setting circuit 11, an amplification circuit 12 and an output transistor M2.

A source of the feedback transistor M1 is configured to connect to a first power supply Vcc, and a drain of the feedback transistor M1 is configured to connect to a first node N1.

The reference setting circuit 11 includes a first bridge arm 111 and a second bridge arm 112 which are connected in parallel. The first bridge arm 111 includes a first resistance sub-circuit R1 and a first voltage adjustment sub-circuit Z1 which are sequentially connected in series. The second bridge arm 112 includes a second resistance sub-circuit R2, a third resistance sub-circuit R3 and a second voltage adjustment sub-circuit Z2 which are sequentially connected in series. Both the first resistance sub-circuit R1 and the second resistance sub-circuit R2 are connected to the first node N1, a resistance value of the first resistance sub-circuit R1 is equal to a resistance value of the second resistance sub-circuit R2, and both the first voltage adjustment sub-circuit Z1 and the second voltage adjustment sub-circuit Z2 are connected to a ground.

An inverting input terminal INN of the amplification circuit 12 is connected to the first bridge arm 111, a non-inverting input terminal INP of the amplification circuit 12 is connected to the second bridge arm 112, and an output terminal of the amplification circuit 12 is connected to a gate of the feedback transistor M1.

A gate of the output transistor M2 is connected to an output terminal of the amplification circuit 12, a source of the output transistor M2 is connected to the first power supply Vcc, and a drain of the output transistor M2 is taken as an output terminal of the bandgap reference circuit 100.

In an embodiment, both the feedback transistor M1 and the output transistor M2 are a PMOS, and in other embodiments, the feedback transistor M1 and the output transistor M2 may also be implemented by other types of transistors, or by a combination of one or more elements to implement the transistor function, which is not particularly limited by the present disclosure.

Taking feedback transistor M1 and output transistor M2 as examples, in the embodiment shown in FIG. 1, the first power supply Vcc supplies current related with the output voltage of the amplification circuit 12 to the first bridge arm 111 and the second bridge arm 112 through the feedback transistor M1 and the first node N1. When a voltage rise of the first bridge arm 111 and the second bridge arm 112 causes a voltage rise of the input terminal of the amplification circuit 12, the output voltage of the amplification circuit 12 rises, a current of drain of the P-type feedback transistor M1 decreases, which reduces the currents of the first bridge arm 111 and the second bridge arm 112, thereby reducing the voltage of input terminal of the amplification circuit 12 and the voltage of output terminal of the amplification circuit 12, thus implementing a negative feedback adjustment, so that the voltage of output terminal of the amplification circuit 12 remains stable, and thus the output current of the output transistor M2 remains stable.

Compared with directly connecting the output terminal of the amplification circuit 12 to the first bridge arm 111 and the second bridge arm 112, the P-type feedback transistor M1 having a source connected to the first power supply Vcc and a gate connected to the output of the amplification circuit 12 can supply a larger and more stable current related to the output of the amplifier circuit 12, so that the first node N1 has a greater current driving capability.

Figure 2:
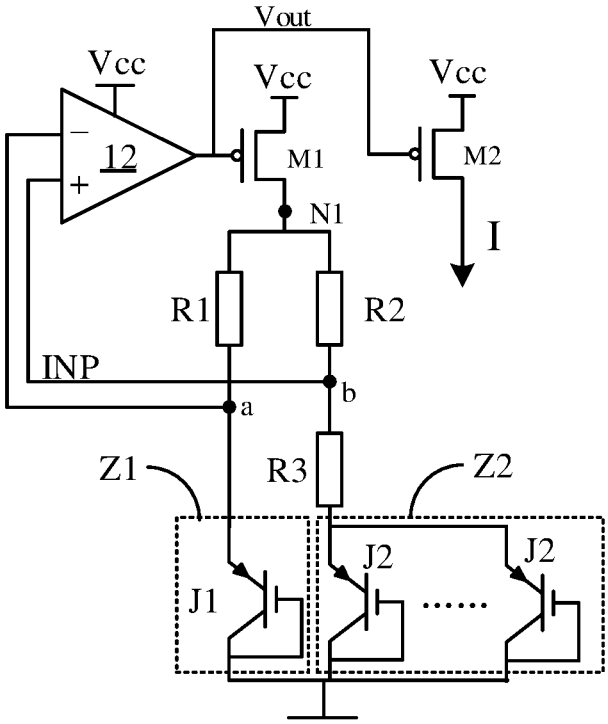
FIG. 2 is a schematic diagram of a voltage adjustment sub-circuit in some embodiments of the present disclosure.

FIG. 2 is a schematic diagram of a voltage adjustment sub-circuit in some embodiments of the present disclosure.

Referring to FIG. 2, both the feedback transistor M1 and the output transistor M2 are PMOS. The drain of the output transistor M2 is used to output the bandgap reference current I. The first voltage adjustment sub-circuit Z1 may include a first PNP triode J1. An emitter of the first PNP triode J1 is connected to the first resistance sub-circuit R1, and both a base and a collector of the first PNP triode J1 are connected to the ground. The second voltage adjustment sub-circuit Z2 includes a plurality of second PNP triodes J2 connected in parallel, an emitter of each second PNP triode is connected to the third resistance sub-circuit R3, and a base and a collector of each second PNP triode are both connected to the ground. The inverting input terminal INN of the amplification circuit 12 is connected to the emitter of the first PNP triode J1 through a node a, and the non-inverting input terminal INP of the amplification circuit 12 is connected to the emitters of the second PNP triodes J2 through a node b.

In the first voltage adjustment sub-circuit Z1, both the base and the collector of the first PNP triode J1 are connected to the ground, and the equivalent resistance to ground is the emitter junction resistance Rbe1 of the first PNP triode J1. In the second voltage adjustment sub-circuit Z2, the base and collector of each second PNP triode J2 are connected to the ground, and the equivalent resistance to ground is the emitter junction resistance Rbe2 of the second PNP triode J2. The equivalent resistance of the whole second voltage adjustment sub-circuit Z2 is the equivalent resistance of a plurality of Rbe2 connected in parallel. The resistance of the second voltage adjustment sub-circuit Z2 is Rbe2/n if the number of the second PNP transistors J2 is n. In the PNP triode whose base is connected to the ground, VCE=VBE, the triode is in a saturation state. Therefore, the first PNP triode J1 and a plurality of second PNP triodes J2 supply stable saturation currents for the first bridge arm 111 and the second bridge arm 112, respectively.

In the circuit shown in FIG. 2, the voltage Vbe1 on the emitter junction resistance Rbe1 of the first PNP triode J1 and the voltage Vbe2 on the emitter junction resistance Rbe2 of the second PNP triode J2 are PN junction voltages, which are negative temperature coefficient characteristic voltages, i.e. the higher the temperature is, the lower the junction voltage is, and the lower the temperature is, the higher the junction voltage is. The voltages on the first resistance sub-circuit R1, the second resistance sub-circuit R2 and the third resistance sub-circuit R3 are all positive temperature coefficient characteristic voltages, i.e., the higher the temperature is, the greater the resistances of the first resistance sub-circuit R1, the second resistance sub-circuit R2 and the third resistance sub-circuit R3 are, and the greater the voltages on the first resistance sub-circuit R1, the second resistance sub-circuit R2 and the third resistance sub-circuit R3 (i.e., the greater the partial voltage is) are.

According to the virtual short characteristic of the amplifier, the voltages of node a and node b are equal, thereby:

$$V(Z1)=V3+V(Z2) \tag{1}$$

V3 is the voltage on the third resistance sub-circuit R3, and V (Z1) and V (Z2) are the voltages on the first voltage adjustment sub-circuit Z1 and the second voltage adjustment sub-circuit Z2, respectively.

Since the voltage across the first resistance sub-circuit R1 is always equal to the voltage across the second resistance sub-circuit R2, and the resistance value of the first resistance sub-circuit R1 is equal to the resistance value of the second resistance sub-circuit R2, the current on the first bridge arm 111 is equal to the current on the second bridge arm 112, both of which are equal to the saturation current Ibe of the first PNP triode J1. Therefore, there is the following formula:

$$V3=V(Z1)-V(Z2)=\ln(n)*V_T=R3*Ibe \tag{2}$$

Herein, n is the number of second PNP triodes J2, In (n)*VT is the difference value between the base-emitter voltages of two bipolar transistors (BJT) operating at different current densities, VT is the voltage equivalent of temperature, with VT=kt/q, k is Boltzmann constant (1.38×10−23J/K), T is thermodynamic temperature, i.e., absolute temperature (300K), and q is electronic charge (1.6×10−19C). At normal atmospheric temperature, VT≈26 mV. VT is a positive temperature coefficient voltage.

Then the voltage Vbgr of the first node N1 is:

$$Vbgr=Vbe1+R1*Ibe=Vbe1+R1*[\ln(n)*V_T/R3] \tag{3}$$

It can be seen that the voltage Vbgr of the first node N1 is the sum of the positive temperature coefficient voltage and the negative temperature coefficient voltage. By adjusting the value of n according to the values of Vbe1, R1 and R3, Vbgr can become a zero temperature coefficient voltage independent of the influence of temperature, i.e., a constant bandgap reference voltage. In an embodiment, n is for example equal to 8. Meanwhile, the voltages of the source and drain of the feedback transistor M1 are constant, the voltage Vout of the gate of the feedback transistor M1 is constant, and the output current (i.e., the bandgap reference current I) of the output transistor M2 controlled by the voltage Vout of the gate of the feedback transistor M1 is constant.

By using PNP triode (BJT) to implement the voltage adjustment sub-circuit, the collector and emitter can be formed by directly doping on N well of substrate. Compared with manufacturing NPN triode, the PNP triode is easier to manufacture by CMOS process in integrated circuit manufacturing process, so that the manufacturing efficiency of bandgap reference circuit in chip can be improved.

Figure 3:
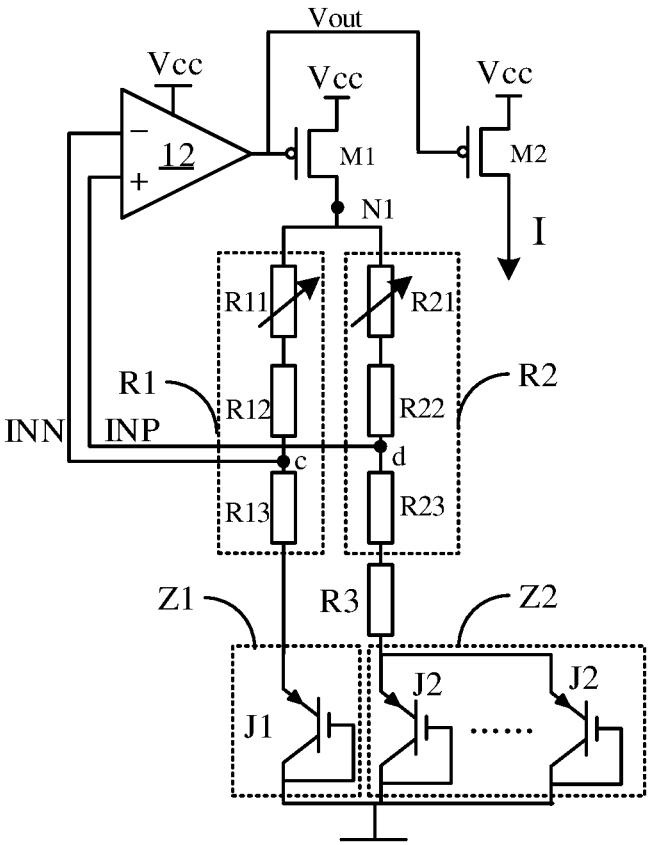
FIG. 3 is a schematic diagram of a first resistance sub-circuit and a second resistance sub-circuit in some embodiments of the present disclosure.

FIG. 3 is a schematic diagram of a first resistance sub-circuit and a second resistance sub-circuit in some embodiments of the present disclosure.

Referring to FIG. 3, in an embodiment, both the first resistance sub-circuit R1 and the second resistance sub-circuit R2 include a plurality of resistances connected in series, For example, the first resistance sub-circuit R1 in FIG. 2 includes resistances R11, R12 and R13 that are connected in series, and the second resistance sub-circuit R2 includes resistances R21, R22 and R23 that are connected in series. The inverting input terminal INN of the amplification circuit 12 is connected to a connection node (for example, c node shown in FIG. 3) of two resistances in the first resistance sub-circuit R1, and the non-inverting input terminal INP of the amplification circuit 12 is connected to a connection node (for example, d node shown in FIG. 3) of two resistances in the second resistance sub-circuit R2. The resistance between the inverting input terminal INN and the first node N1 is equal to the resistance between the non-inverting input terminal INP and the first node N1. That is, in the embodiment shown in FIG. 2, R11+R12=R21+R22. R11, R12, R21 and R22 represent the resistance values of resistance R11, R12, R21 and R22, respectively. The numbers of resistances in the first resistance sub-circuit R1 and the second resistance sub-circuit R2 may be equal or not equal only if the above limiting conditions are satisfied.

The connection node between the amplification circuit 12 and the first bridge arm 111 and the connection node between the amplification circuit 12 and the second bridge arm 112 are set between two resistances, instead of directly connecting to the emitter of the first voltage adjustment sub-circuit Z1 and one terminal of the third resistance sub-circuit R3, the voltage of input terminal of the amplification circuit 12 can be increased, and the output voltage Vout of the amplification circuit 12 can be increased, so that the voltage of gate of the output transistor M2 can be increased, and the current driving capability of the bandgap reference circuit can be improved.

In one embodiment, the resistance R11 may be a first adjustable resistance, and the resistance R21 may be a second adjustable resistance. A resistance value of the first adjustable resistance R11 is equal to a resistance value of the second adjustable resistance R21. A resistance between a terminal of the first adjustable resistance R11 away from the first node N1 and the first node N1 is equal to a resistance between a terminal of the second adjustable resistance R21 away from the first node N1 and the first node N1. In the embodiment shown in FIG. 3, R11=R21, R12=R22, and R13=R23, thereby maintaining R1=R2.

In the embodiment shown in FIG. 3, both the first adjustable resistance R11 and the second adjustable resistance R21 are directly connected to the first node N1. The resistance value of the first adjustable resistance R11 is equal to the resistance value of the second adjustable resistance R21. When there are other resistances between the first adjustable resistance R11 and the first node N1, and/or there are other resistances between the second adjustable resistance R21 and the first node N1, the equivalent relationship of the resistances is similar. That is, the resistance between the node c and the first node N1 always maintains equal to the resistance between the node d and the first node N1.

By simultaneously setting adjustable resistances with the same resistance value in the first resistance sub-circuit R1 and the second resistance sub-circuit R2, the resistances and currents of the first bridge arm 111 and the second bridge arm 112 are adjusted simultaneously while adjusting the voltage of input terminal of the amplification circuit 12.

Figure 4:
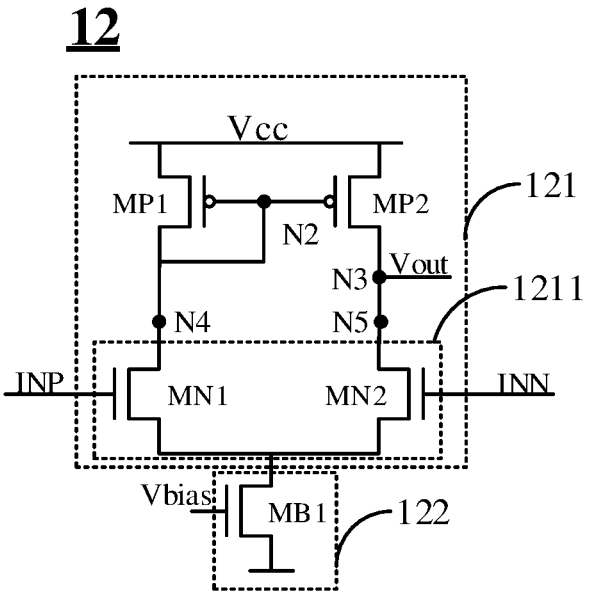
FIG. 4 is a first schematic diagram of an amplification circuit in some embodiments of the present disclosure.

FIG. 4 is a schematic diagram of an amplification circuit in some embodiments of the present disclosure.

Referring to FIG. 4, in an embodiment of the present disclosure, the amplification circuit 12 includes a first-stage amplification circuit 121 and a bias sub-circuit 122. The bias sub-circuit 122 includes a first-stage bias transistor MB1. A first terminal of the first-stage amplification circuit 121 is configured to connect to the first power supply Vcc, and a second terminal of the first-stage amplification circuit 121 is configured to connect to a drain of the first-stage bias transistor MB1 in the bias sub-circuit 122. The first-stage amplification circuit 121 includes a first P-type transistor MP1, a second P-type transistor MP2 and a first amplification sub-circuit 1211.

A source of the first P-type transistor MP1 is connected to the first power supply Vcc, and both a gate and a drain of the first P-type transistor MP1 are connected to a second node N2.

A source of the second P-type transistor MP2 is connected to the first power supply Vcc, a gate of the second P-type transistor MP2 is connected to the second node N2, and a drain of the second P-type transistor MP2 is connected to a third node N3.

The first amplification sub-circuit 1211 includes a first N-type transistor MN1 and a second N-type transistor MN2.

A gate of the first N-type transistor MN1 is connected to the non-inverting input terminal INP of the amplification circuit 12, a source of the first N-type transistor MN1 is electrically connected to the drain of the first-stage bias transistor MB1 in the bias sub-circuit 122, and a drain of the first N-type transistor MN1 is connected to a fourth node N4. The fourth node N4 is electrically connected to the second node N2.

A gate of the second N-type transistor MN2 is connected to the inverting input terminal INN of the amplification circuit 12, a source of the second N-type transistor MN2 is electrically connected to the drain of the first-stage bias transistor MB1 in the bias sub-circuit 122, a drain of the second N-type transistor MN2 is connected to a fifth node N5. The fifth node N5 is electrically connected to the third node N3.

A gate of the first-stage bias transistor MB1 is configured to receive a bias signal Vbias, and a source of the first-stage bias transistor MB1 is connected to the ground.

The embodiment shown in FIG. 4 may be applied to the circuits shown in FIG. 1 to FIG. 3. The gate of the first N-type transistor MN1 is taken as the non-inverting input terminal INP of the amplification circuit 12, the gate of the second N-type transistor MN2 is taken as the inverting input terminal of the amplification circuit 12, and the third node N3 is taken as the output terminal of the amplification circuit 12.

In the embodiment shown in FIG. 4, the fourth node N4 is directly connected to the second node N2, the fifth node N5 is directly connected to the third node N3.

Figure 5:
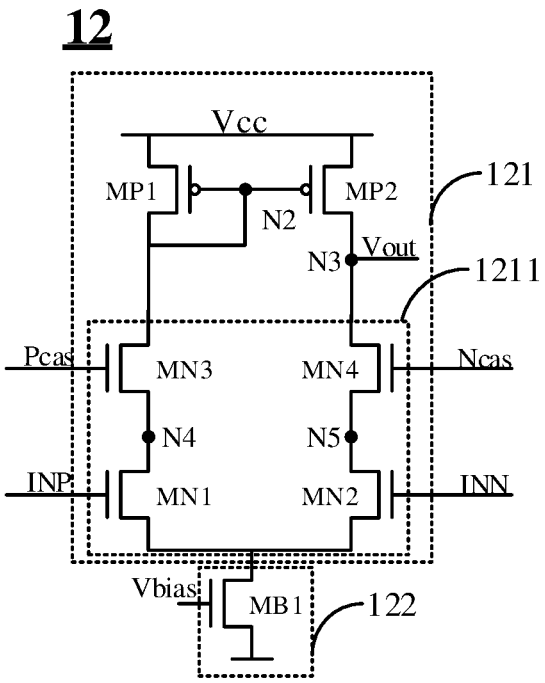
FIG. 5 is a second schematic diagram of an amplification circuit in some embodiments of the present disclosure.

FIG. 5 is a schematic diagram of an amplification circuit in some embodiments of the present disclosure.

Referring to FIG. 5, in another embodiment, the first amplification sub-circuit 1211 further includes a third N-type transistor MN3 and a fourth N-type transistor MN4.

The gate of the third N-type transistor MN3 is connected to the second resistance sub-circuit R2, a source of the third N-type transistor MN3 is connected to the fourth node N4, and a drain of the third N-type transistor MN3 is connected to the second node N2.

A gate of the fourth N-type transistor MN4 is connected to the first resistance sub-circuit R1, a source of the fourth N-type transistor MN4 is connected to the fifth node N5, and a drain of the fourth N-type transistor MN4 is connected to the third node N3.

A resistance between the gate of the third N-type transistor MN3 and the first node N1 is equal to a resistance between the gate of the fourth N-type transistor MN4 and the first node N1, and a resistance between the gate of the third N-type transistor MN3 and the first node N1 is less than a resistance between the gate of the first N-type transistor MN1 and the first node N1.

As shown in FIG. 5, the gate of the third N-type transistor MN3 is connected to a bias voltage Pcas, and the gate of the fourth N-type transistor MN4 is connected to a bias voltage Ncas.

In the embodiment shown in FIG. 5, the first amplification sub-circuit 121 after stacking the third N-type transistor MN3 and the fourth N-type transistor MN4 constitutes a cascade operational amplifier structure, that is, a cascode amplifier structure. The input terminals of MN1 and MN2 are gates, and the output terminals of MN1 and MN2 are drains. The MN1 and MN2 constitute a common source amplifier structure. The input terminals of MN3 and MN4 are sources, and the output terminals of MN3 and MN4 are drains. The MN3 and MN4 constitute a common gate amplifier structure.

By using a current mirror of self-biased cascade structure in the amplification circuit 12, the gain of the amplification circuit 12 can be increased, and the power supply rejection ratio of the output voltage Vout can be increased, so that the amplification circuit 12 can coordinate with an external circuit to generate a reference voltage of zero temperature coefficient with stable performance.

In order to prevent the stacked third N-type transistor MN3 and the fourth N-type transistor MN4 from becoming a bottleneck affecting the output driving capability of the amplification circuit 12, when setting the bias voltage Pcas and the bias voltage Ncas, it is necessary to ensure that the bias voltage Pcas is higher than the voltage of the non-inverting input terminal INP of the amplification circuit 12 and the bias voltage Ncas is higher than the voltage of the inverting input terminal INN of the amplification circuit 12.

Figure 6:
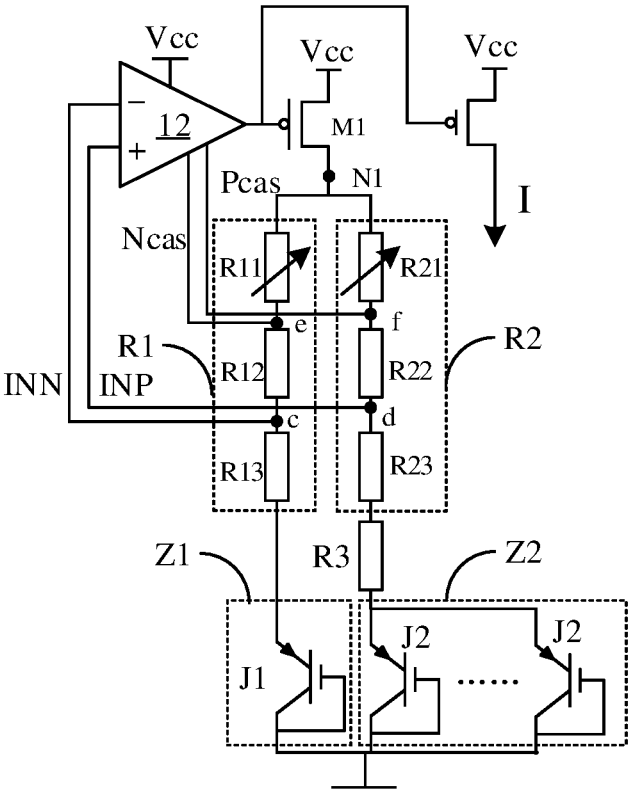
FIG. 6 is a schematic diagram of the connection relationship of the amplification circuit corresponding to FIG. 5.

FIG. 6 is a schematic diagram of the connection relationship of the amplification circuit corresponding to FIG. 5.

Referring to FIG. 6, the bias voltage Ncas is the voltage of the connection node e of the two resistances in the first resistance sub-circuit R1, and the bias voltage Pcas is the voltage of the connection node f of the two resistances in the second resistance sub-circuit R2. The resistance between the node e and the first node N1 is equal to the resistance between the node f and the first node N1. The resistance (R11 as shown in FIG. 6) between the node e and the first node N1 is less than the resistance (R11+R12 as shown in FIG. 6) between the node c and the first node N1. The voltage of the node e is higher than the voltage of the node c. That is, the voltage of the bias voltage Ncas is higher than the input voltage of the inverting input INN of the amplification circuit 12. The resistance (R21 as shown in FIG. 6) between the node f and the first node N1 is smaller than the resistance (R21+R22 as shown in FIG. 6) between the node d and the first node N1. The voltage of the node f is higher than the voltage of the node d. That is, the voltage of the bias voltage Pcas is higher than the input voltage of the non-inverting input terminal INP of the amplification circuit 12.

In an embodiment, the resistance R11 may be a first adjustable resistance, and the resistance R21 may be a second adjustable resistance. The resistance value of the first adjustable resistance R11 is equal to the resistance value of the second adjustable resistance R21.

By simultaneously setting adjustable resistances with the same resistance value to the first bridge arm 111 and the second bridge arm 112, the first bridge arm 111 and the second bridge arm 112 are adjusted simultaneously while adjusting the voltage of input terminal of the amplification circuit 12 and the bias voltages Pcas and Ncas, so as to maintain Pcas=Ncas.

In an embodiment of the present disclosure, each of the transistors in the first amplification sub-circuit 1211 is Thick OX MOS, which has high withstand voltage capability. The first P-type transistor MP1 and the second P-type transistor MP2 may also be a Thick OX MOS, so as to improve the withstand voltage capability of the first-stage amplification circuit 121.

Figure 7:
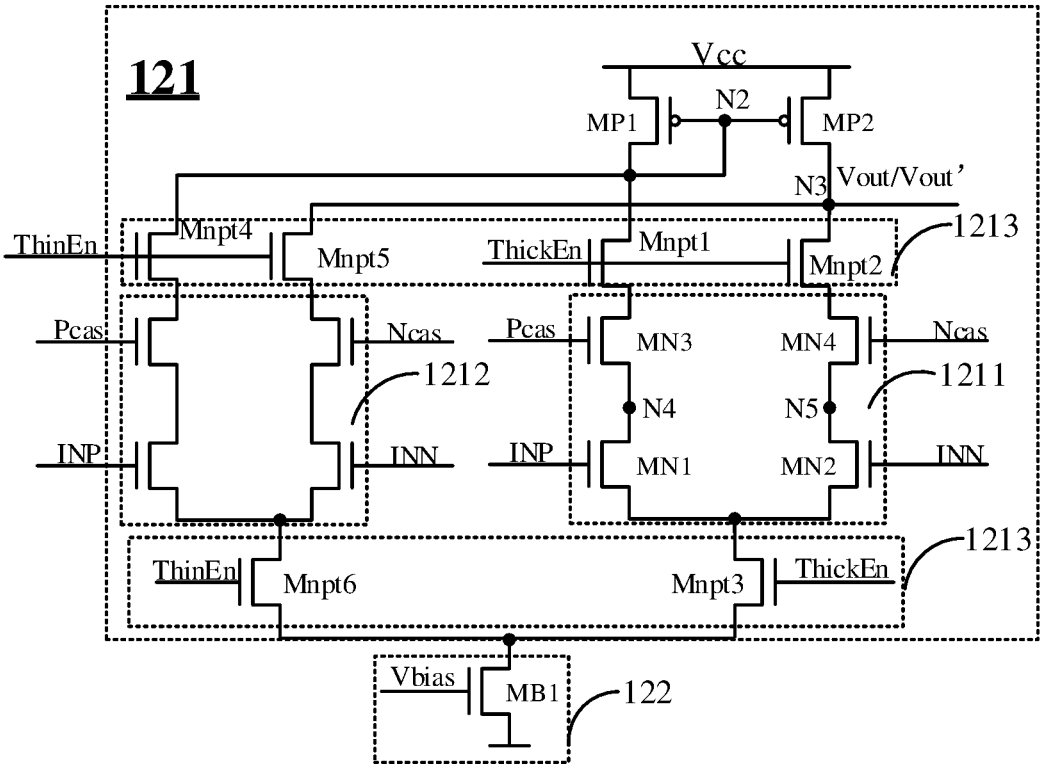
FIG. 7 is a schematic diagram of a first-stage amplification circuit in some embodiments of the present disclosure.

FIG. 7 is a schematic diagram of a first-stage amplification circuit in some embodiments of the present disclosure.

Referring to FIG. 7, when each of the transistors in the first amplification sub-circuit 1211 is Thick OX MOS, the first-stage amplification circuit 121 may further include a second amplification sub-circuit 1212 and a control circuit 1213.

The second amplification sub-circuit 1212 is connected in parallel with the first amplification sub-circuit 1211. The second amplification sub-circuit 1212 has a same circuit structure and an input signal as the first amplification sub-circuit 1211. The second amplification sub-circuit 1212 is configured to output a second amplification signal Vout' through the third node N3 according to input signals of the non-inverting input terminal INP and the inverting input terminal INN. Each transistor in the second amplification sub-circuit 1212 is Thin OX MOS. That is, at least the gate oxide thickness of the Nmos transistor in the first amplification sub-circuit 1211 is greater than the gate oxide thickness of the Nmos transistor in the second amplification sub-circuit 1212.

The control circuit 1213 is configured to control that there is one, and only one, of the first amplification sub-circuit 1211 and the second amplification sub-circuit 1212 is enabled at the same time.

In the embodiment shown in FIG. 7, the control circuit 1213 is implemented by using a first control transistor Mnpt1 connected between the first amplification sub-circuit 1211 and the second node N2, a second control transistor Mnpt2 connected between the first amplification sub-circuit 1211 and the third node N3, a third control transistor Mnpt3 connected between the first amplification sub-circuit 1211 and the bias sub-circuit 122, a fourth control transistor Mnpt4 connected between the second amplification sub-circuit 1212 and the second node N2, a fifth control transistor Mnpt5 connected between the second amplification sub-circuit 1212 and the third node N3, and a sixth control transistor Mnpt6 connected between the second amplification sub-circuit 1212 and the bias sub-circuit 122. The gates of the first control transistor Mnpt1, the second control transistor Mnpt2, and the third control transistor Mnpt3 are connected to the first amplification sub-circuit enabling signal ThickEn, and the gates of the fourth control transistor Mnpt4, the fifth control transistor Mnpt5, and the sixth control transistor Mnpt6 are connected to the second amplification sub-circuit enabling signal ThinEN. The first amplification sub-circuit enabling signal ThickEn and the second amplification sub-circuit enabling signal ThinEN are configured to control that there is one, and only one, of the first amplification sub-circuit 1211 and the second amplification sub-circuit 1212 is enabled at the same time.

When the first control transistor Mnpt1, the second control transistor Mnpt2, the third control transistor Mnpt3, the fourth control transistor Mnpt4, the fifth control transistor Mnpt5, and the sixth control transistor Mnpt6 are transistors with a same type. For example, when they are N-type transistors as shown in FIG. 7, the phase of the first amplification sub-circuit enabling signal ThickEn is opposite to the phase of the second amplification sub-circuit enabling signal ThinEN.

In other embodiments, the control circuit 1213 may also have other forms, which are not particularly limited by the present disclosure. It is controlled by the control circuit 1213 that there is one, and only one, of the first amplification sub-circuit 1211 composed of Thick OX MOSs and the second amplification sub-circuit 1212 composed of a Thin OX MOSs is enabled sub-circuit at the same time. The first amplification sub-circuit 1211 can be enabled when a higher withstand voltage is required and the second amplification sub-circuit 1212 can be enabled when a faster reaction speed is required, thereby flexible arrangement of the amplification circuit 12 is achieved.

Figure 8:
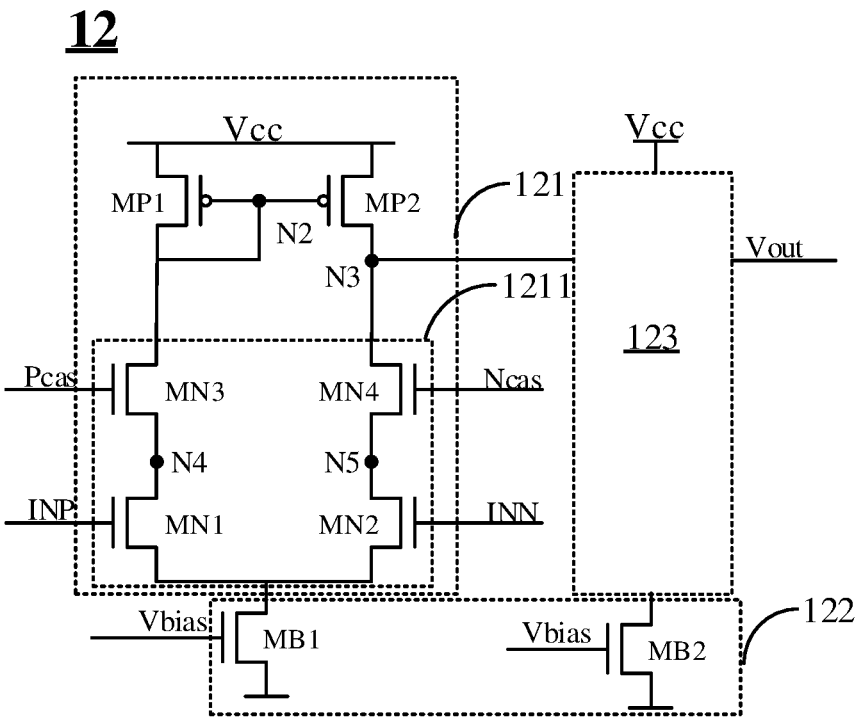
FIG. 8 is a schematic diagram of an amplification circuit in some embodiments of the present disclosure.

FIG. 8 is a schematic diagram of an amplification circuit in some embodiments of the present disclosure.

Referring to FIG. 8, in an embodiment of the present disclosure, the bias sub-circuit 122 includes a second-stage bias transistor MB2. The amplification circuit 12 further includes a second-stage amplification circuit 123.

An input terminal of the second-stage amplification circuit 123 is connected to the first-stage amplification sub-circuit 121. A first terminal of the second-stage amplification circuit 123 is connected to the first power supply Vcc. The second terminal of the second-stage amplification circuit 123 is connected to a drain of the second-stage bias transistor MB2 in the bias sub-circuit 122. The second-stage amplification circuit 123 is configured for a second time of amplification of an output signal of the first-stage amplification sub-circuit 121. A gate of the second-stage bias transistor MB2 is configured to receive the bias signal Vbias, and a source of the second-stage bias transistor MB2 is connected to the ground.

In the embodiment shown in FIG. 8, the input terminal of the second-stage amplification circuit 123 is connected to the output terminal of the first-stage amplification circuit 121, i.e., the third node N3. The output terminal of the second-stage amplification circuit 123 outputs the signal after the second time of amplification as the output terminal of the amplification circuit 12.

The second-stage amplification circuit 123 may be implemented by a plurality of circuits having an amplification function, or may be provided with an enabling function to enable or disable the second-stage amplification function. The arrangement of the second-stage amplification circuit 123 can improve the gain of the amplification circuit 12.

In addition to the embodiment shown in FIG. 8, the second-stage amplification circuit 123 may also be set in the embodiment shown in FIG. 7 in which the second amplification sub-circuit 1212 is set. The second-stage amplification circuit 123 is configured to perform the second time of amplification on the first amplification signal output by the first amplification sub-circuit 121 composed of Thick OX MOS or the second amplification signal output by the second amplification sub-circuit 122 composed of Thin OX MOS, to form an amplification circuit 12 of multistage hybrid architecture with optional functions. For a detailed circuit example, reference is made to the embodiment shown in FIG. 15.

Figure 9:
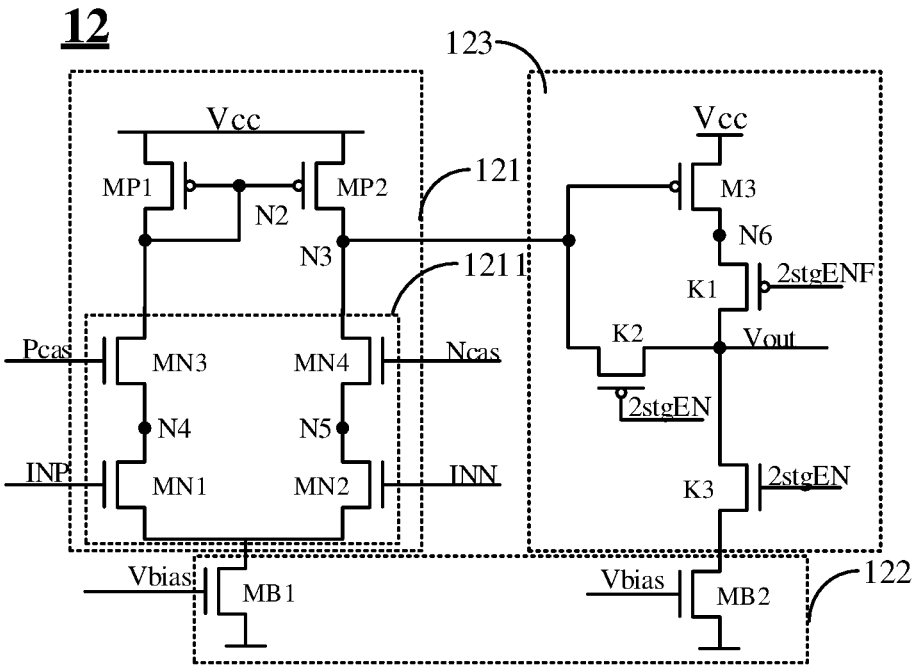
FIG. 9 is a schematic diagram of a second-stage amplification circuit in some embodiments of the present disclosure.

FIG. 9 is a schematic diagram of the second-stage amplification circuit in some embodiments of the present disclosure.

Referring to FIG. 9, in an embodiment of the present disclosure, the second-stage amplification circuit 123 may include a second-stage amplification transistor M3, a first switch transistor K1, a second switch transistor K2 and a third switch transistor K3.

A gate of the second-stage amplification transistor M3 is connected to the third node N3, a source of the second-stage amplification transistor M3 is connected to the first power supply Vcc, and a drain of the second-stage amplification transistor M3 is connected to a sixth node N6.

The first switch transistor K1 is a P-type transistor. A first terminal of the first switch transistor K1 is connected to the sixth node N6, a second terminal of the first switch transistor K2 is connected to the output terminal of the amplification circuit 12, and a control terminal of the first switch transistor K1 is connected to an inverting signal 2stgENF of a second-stage gain enabling 2stgEN.

The second switch transistor K2 is a P-type transistor. A first terminal of the second switch transistor K2 is connected to the third node N3, a second terminal of the second switch transistor K2 is connected to the output terminal of the amplification circuit 12, and a control terminal of the second switch transistor K2 is connected to the second-stage gain enabling signal 2stgEN.

The third switch transistor K3 is an N-type transistor. A first terminal of the third switch transistor K3 is connected to the output terminal of the amplification circuit 12, a control terminal of the third switch transistor K3 is connected to the second-stage gain enabling signal 2stgEN, and a second terminal of the third switch transistor K3 is connected to the drain of the second-stage bias transistor MB2.

In the circuit shown in FIG. 9, when the second-stage gain enabling signal 2stgEN is at a high level and the inverting signal 2stgENF of the second-stage gain enabling signal 2stgEN is at a low level, the first switch transistor K1 and the third switch transistor K3 are conductive, and the second switch transistor K2 is turned off. At this time, the amplification signal output by the first-stage amplification circuit 121, i.e. the signal of the third node N3, controls the gate of the second-stage amplification transistor M3, and the drain of the second-stage amplification transistor M3 is connected to the ground through the conductive first switch transistor K1, the conductive third switch transistor K3 and the biased second-stage bias transistor MB2. The output signal Vout of the amplification circuit 12 is a drain signal of the second-stage amplification transistor M3. The second-stage amplification transistor M3 constitutes a common source stage amplification circuit and is used for the second time of amplification of the signal of the third node N3. Vout is inverted with the signal of the third node N3. The inverting signal 2stgEN of the second-stage gain enabling signal 2stgEN may be implemented by a circuit having an inverting function in which the input terminal is connected to the 2stgEN, which is not particularly limited by the present disclosure.

When the second-stage gain enabling signal 2stgEN is at a low level and the inverting signal 2stgENF of the second-stage gain enabling signal 2stgEN is at a high level, both the first switch transistor K1 and the third switch transistor K3 are turned off, and the second switch K2 is conductive. The signal of the third node N3 is directly taken as the output signal Vout of the amplification circuit 12. That is, the second-stage amplification function is disabled.

In addition to the circuit shown in FIG. 9, a person skilled in the art may also set a second-stage amplification circuit 123 through other circuits, as long as the amplification function can be implemented.

Figure 10:
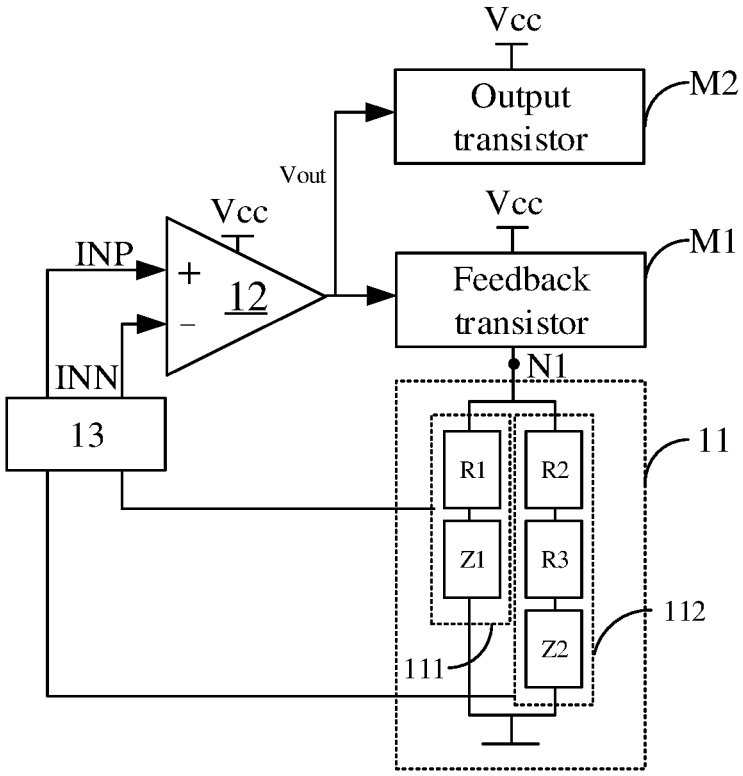
FIG. 10 is a schematic diagram of a bandgap reference circuit corresponding to the embodiment shown in FIG. 9 in an embodiment of the present disclosure.

FIG. 10 is a schematic diagram of a bandgap reference circuit corresponding to the embodiment shown in FIG. 9 according to some embodiments of the present disclosure.

In the embodiment shown in FIG. 9, when the second-stage amplification transistor is a P-type transistor, the output signal Vout of the amplification circuit 12 is inverted with the signal of the third node N3. That is, the output signal of the second-stage amplification circuit 123 is inverted with the output signal of the first-stage amplification circuit 121.

In order to enable the output signal of the second-stage amplification circuit 123 to characterize the voltage difference of the bridge arms, rather than the opposite value of the voltage difference, the bandgap reference circuit may further include an input signal exchange sub-circuit 13.

The input signal exchange sub-circuit 13 is connected between the non-inverting input terminal INP and the inverting input terminal INN of the amplification circuit 12 and the first bridge arm 111 and the second bridge arm 112. The input signal exchange sub-circuit 13 is configured to control the inverting input terminal INN of the amplification circuit 12 to connect the first bridge arm 111 and the non-inverting input terminal INP of the amplification circuit 12 to connect the second bridge arm 112 when the second-stage gain enabling signal 2stgEN is dormant, or control an input signal of the non-inverting input terminal INP of the amplification circuit 12 to exchange with an input signal of the inverting input terminal INP of the amplification circuit when the second-stage gain enabling signal 2stgEN is active.

The input signal exchange sub-circuit 13 shown in FIG. 10 may be applied to any circuit set with a second-stage amplification circuit 123 that inversely amplifies an output signal of the first-stage amplification circuit 121, and a circuit, including but not limited to, set with a second amplification sub-circuit 1212.

Figure 11:
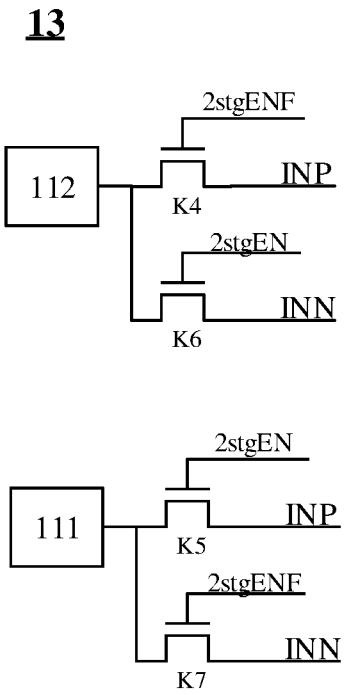
FIG. 11 is a schematic diagram of an input signal exchange sub-circuit in some embodiments of the present disclosure.

FIG. 11 is a schematic diagram of an input signal exchange sub-circuit in some embodiments of the present disclosure.

Referring to FIG. 11, in an embodiment of the present disclosure, the input signal exchange sub-circuit 13 may include a fourth switch transistor K4, a fifth switch transistor K5, a sixth switch transistor K6 and a seventh switch transistor K7.

The fourth switch transistor K4 is an N-type transistor. A first terminal of the fourth switch transistor K4 is connected to the non-inverting input terminal INP, the second terminal of the fourth switch transistor K4 is connected to the second bridge arm 112, and the gate of the fourth switch transistor K4 is connected to the inverting signal 2stgENF of a second-stage gain enabling signal.

The fifth switch transistor K5 is an N-type transistor. A first terminal of the fifth switch transistor K5 is connected to the non-inverting input terminal INP, a second terminal of the fifth switch transistor K5 is connected to the first bridge arm 111, and a gate of the fifth switch transistor K5 is connected to the second-stage gain enabling signal 2stgEN.

The sixth switch transistor K6 is an N-type transistor. A first terminal of the sixth switch transistor K6 is connected to the inverting input terminal INN, a second terminal of the sixth switch transistor K6 is connected to the second bridge arm 112, and a gate of the sixth switch transistor K6 is connected to the second-stage gain enabling signal 2stgEN.

The seventh switch transistor K7 is an N-type transistor. A first terminal of the seventh switch transistor K7 is connected to the inverting input terminal INN, a second terminal of the seventh switch transistor K7 is connected to the first bridge arm 111, and a gate of the seventh switch transistor K7 is connected to the inverting signal 2stgENF of a second-stage gain enabling signal.

In the embodiment shown in FIG. 11, when the second-stage gain enabling signal 2stgEN is at a high level and the inverting signal 2stgENF of the second-stage gain enabling signal 2stgEN is at a low level, the fourth switch transistor K4 is turned off, the fifth switch transistor K5 is conductive, and the inverting input terminal INN is connected to the second bridge arm 112. The fifth switch transistor K5 is conductive, the seventh switch transistor K7 is turned off, and the non-inverting input terminal INP is connected to the first bridge arm 111 to implement the exchange of the input signals of the two input terminals of the amplification circuit 12, so that the output signal (the signal of the third node N3) of the first-stage amplification circuit 121 in the amplification circuit 12 is inverted. Meanwhile, since the second-stage amplification circuit 123 is enabled (see the embodiment shown in FIG. 9), the output signal of the amplification circuit 12 is an inverted signal of the output signal of the first-stage amplification circuit 121, so that the output signal of the amplification circuit 12 at this time is in phase with that when only the first-stage amplification circuit 121 is set.

When the second-stage gain enabling signal 2stgEN is at a low level and the inverting signal 2stgENF of the second-stage gain enabling signal 2stgEN is at a high level, the fourth switch transistor K4 is conductive, the fifth switch transistor K5 is turned off, and the inverting input terminal INN is connected to the first bridge arm 111. The fifth switch transistor K5 is turned off, the seventh switch transistor K7 is conductive, and the non-inverting input terminal INP is connected to the second bridge arm 112. Since the second-stage amplification circuit 123 is disabled at this time, the output signal Vout of the amplification circuit 12 is the output signal of the first-stage amplification circuit 121 (the signal of the third node N3), and the circuit output performance at this time is the same as when only the first-stage amplification circuit 121 is set.

Figure 12:
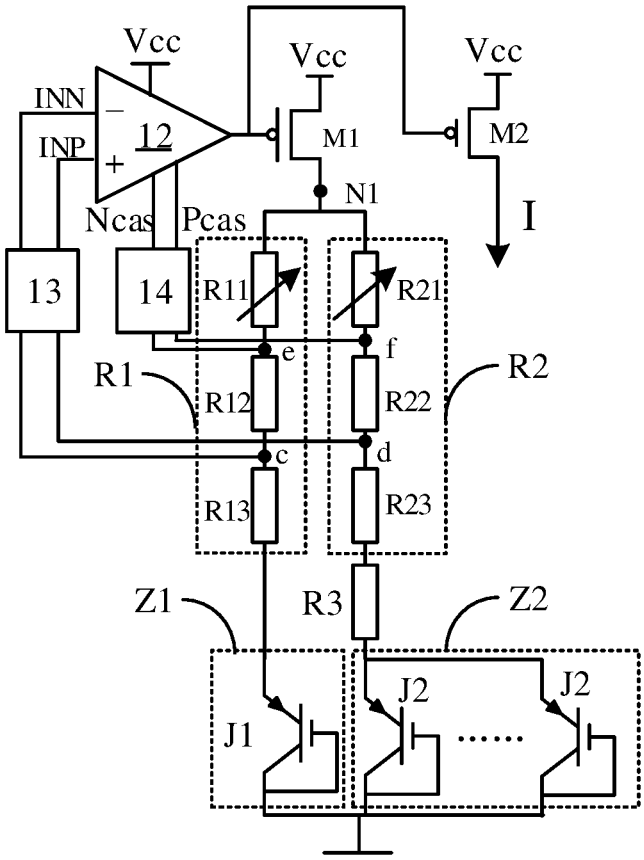
FIG. 12 is a schematic diagram of a bandgap reference circuit in some embodiments of the present disclosure.

FIG. 12 is a schematic diagram of a bandgap reference circuit in some embodiments of the present disclosure.

Referring to FIG. 12, in an embodiment of the present disclosure, when the first amplification sub-circuit 1211 includes the third N-type transistor MN3 and the fourth N-type transistor MN4, the band gap reference circuit further includes the gain control exchange sub-circuit 14.

The gain control exchange sub-circuit 14 is connected between the gate of the third N-type transistor MN3 and the gate of the fourth N-type transistor MN4 and the first resistance sub-circuit R1 and the second resistance sub-circuit R2. The gain control exchange sub-circuit 14 is configured to control the gate of the third N-type transistor MN3 to connect to the second resistance sub-circuit R2 and the gate of the fourth N-type transistor MN4 to connect to the first resistance sub-circuit R1 when the second-stage gain enabling signal 2stgEN is dormant, or control a connection point of the gate of the third N-type transistor MN3 to exchange with a connection point of the gate of the fourth N-type transistor MN4 when the second-stage gain enabling signal 2stgEN is active.

The gain control exchange sub-circuit 14 and the input signal exchange sub-circuit 13 need to exist at the same time, so that when the input signals of the amplification sub-circuit 12 are exchanged, the bias voltage Pcas and the bias voltage Ncas of the cascade structure corresponding to the input signals are exchanged, and the exchange of input signals of the whole amplification sub-circuit (first amplification sub-circuit 1211, second amplification sub-circuit 1212) is implemented.

Figure 13:
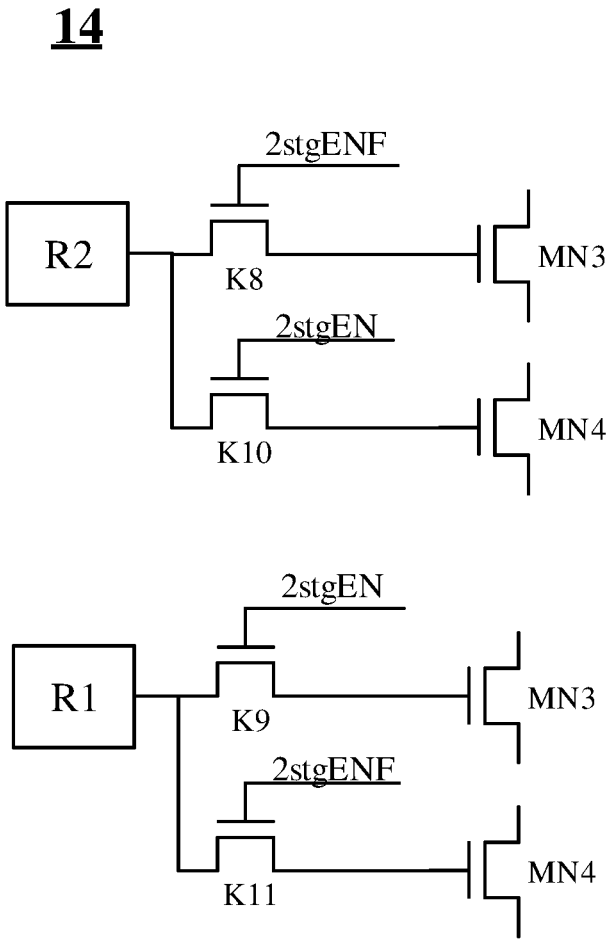
FIG. 13 is a schematic diagram of a gain control exchange sub-circuit in some embodiments of the present disclosure.

FIG. 13 is a schematic diagram of a gain control exchange sub-circuit in some embodiments of the present disclosure.

Referring to FIG. 13, in the embodiment of the present disclosure, the gain control exchange sub-circuit 14 may include an eighth switch transistor K8, a ninth switch transistor K9, a tenth switch transistor K10 and an eleventh switch transistor K11.

The eighth switch transistor K8 is an N-type transistor. A first terminal of the eighth switch transistor K8 is connected to the gate of the third N-type transistor MN3, a second terminal of the eighth switch transistor K8 is connected to the second resistance sub-circuit R2, and a gate of the eighth switch transistor K8 is connected to the inverting signal 2stgENF of the second-stage gain enabling signal.

The ninth switch transistor K9 is an N-type transistor. A first terminal of the ninth switch transistor K9 is connected to the gate of the third N-type transistor MN3, a second terminal of the ninth switch transistor K9 is connected to the first resistance sub-circuit R1, and a gate of the ninth switch transistor K9 is connected to the second-stage gain enabling signal 2stgEN.

The tenth switch transistor K10 is an N-type transistor. A first terminal of the tenth switch transistor K10 is connected to the gate of the fourth N-type transistor MN4, a second terminal of the tenth switch transistor K10 is connected to the second resistance sub-circuit R2, and a gate of the tenth switch transistor K10 is connected to the second-stage gain enabling signal 2stgEN.

The eleventh switch transistor K11 is an N-type transistor. A first terminal of the eleventh switch transistor K11 is connected to the gate of the fourth N-type transistor MN4, a second terminal of the eleventh switch transistor K11 is connected to the first resistance sub-circuit R1, and a gate of the eleventh switch transistor K11 is connected to the inverting signal 2stgENF of the second-stage gain enabling signal.

When the second-stage gain enabling signal 2stgEN is at a low level and the inverting signal 2stgENF of the second-stage gain enabling signal 2stgEN is at a high level, the eighth switch transistor K8 and the eleventh switch transistor K11 are conductive, the ninth switch transistor K9 and the tenth switch transistor K10 are turned off, the gate of the third N-type transistor MN3 is connected to the second resistance sub-circuit R2, and the gate of the fourth N-type transistor MN4 is connected to the first resistance sub-circuit R1, which is the same as the case of the second-stage amplification circuit 123 is not set. When the second-stage gain enabling signal 2stgEN is at a high level and the inverting signal 2stgENF of the second-stage gain enabling signal 2stgEN is at a low level, the eighth switch transistor K8 and the eleventh switch transistor K11 are turned off, the ninth switch transistor K9 and the tenth switch transistor K10 are conductive, the gate of the third N-type transistor MN3 is connected to the first resistance sub-circuit R1, the gate of the fourth N-type transistor MN4 is connected to the second resistance sub-circuit R2, the gate control signal of the third N-type transistor MN3 is exchanged with the gate control signal of the fourth N-type transistor MN4, and the exchange is occurred simultaneously with the exchange of the input signals of the amplification circuit 12, so that the output signal of the amplification circuit 12 is the same as the case of only the first-stage amplification circuit 121 is set, and the phase of the output signal is prevented from being inverted by the second-stage amplification circuit 123 implemented through the P-type transistor.

Figure 14:
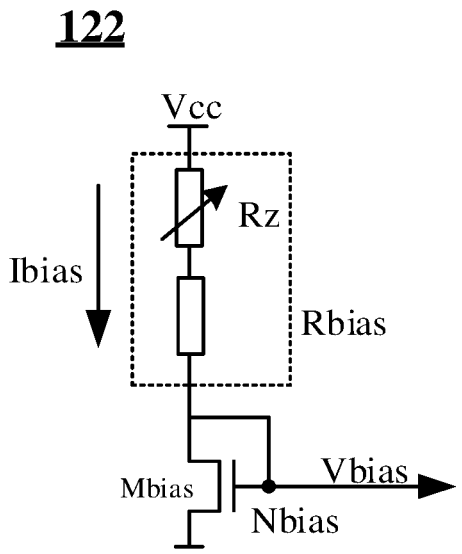
FIG. 14 is a schematic diagram of a bias sub-circuit in some embodiments of the present disclosure.

FIG. 14 is a schematic diagram of a bias sub-circuit in some embodiments of the present disclosure.

Referring to FIG. 14, in an embodiment of the present disclosure, the bias sub-circuit 122 further includes a bias resistance sub-circuit Rbias and a self-bias transistor Mbias.

A first terminal of the bias resistance sub-circuit Rbias is connected to the first power supply Vcc, and a second terminal of the bias resistance sub-circuit Rbias is connected to a bias node Nbias. The bias node Nbias is configured to transmit the bias signal Vbias, and the bias resistance sub-circuit Rbias includes an adjustable resistance RZ.

Both a gate and a drain of the self-bias transistor Mbias are connected to the bias node Nbias, and a source of the self-bias transistor Mbias is connected to the ground.

In the embodiment shown in FIG. 14, the bias resistance sub-circuit Rbias may include a plurality of resistances connected in series, one or more of which are adjustable resistances, so that the bias current Ibias flowing through the bias node Nbias is adjusted. The gates of the first-stage bias transistor MB1 and the second-stage bias transistor MB2 in the foregoing embodiment are connected to the bias node Nbias to receive the bias signal Vbias.

The bias sub-circuit 122 is configured to supply stable bias voltage for the first-stage bias transistor MB1 and the second-stage bias transistor MB2, and can also be implemented by various circuits, which can be set by the skilled person in the art according to the actual situation, which is not particularly limited in the present disclosure.

Figure 15:
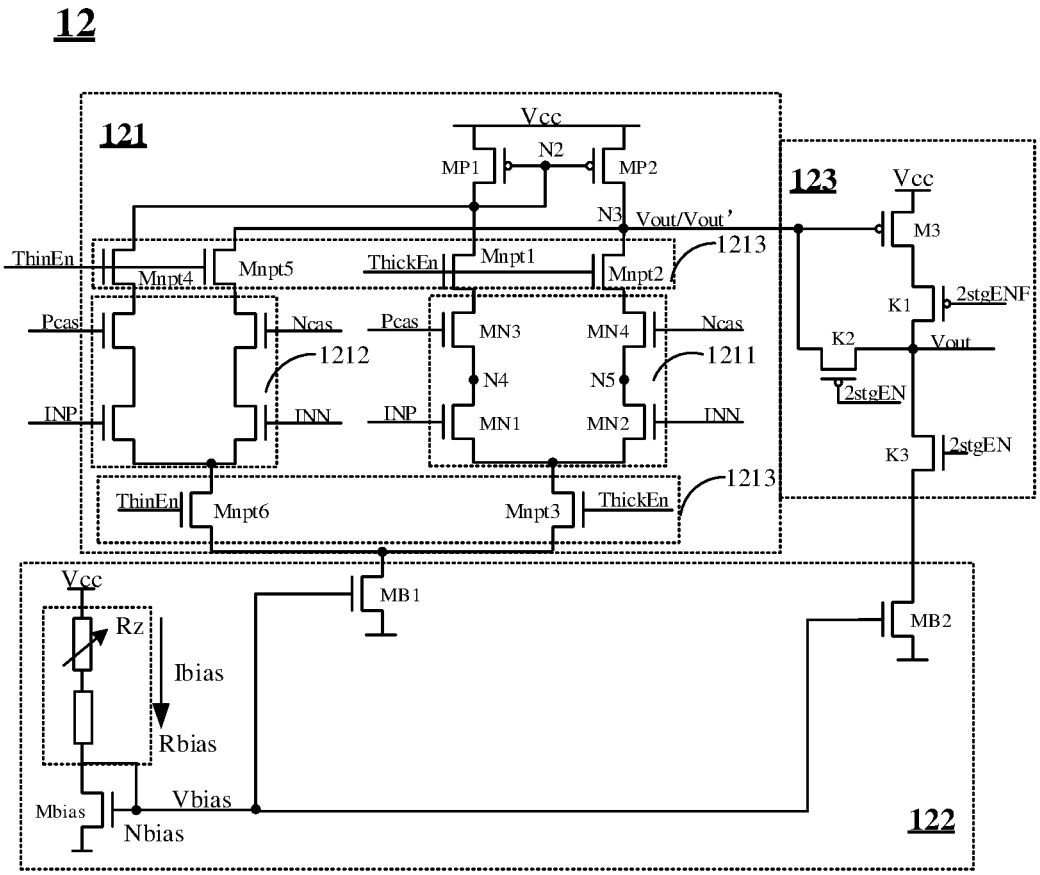
FIG. 15 is a circuit diagram of an amplification circuit in some embodiments of the present disclosure.

FIG. 15 is a circuit diagram of an amplification circuit in some embodiments of the present disclosure.

Referring to FIG. 15, the amplification circuit 12 includes a first-stage amplification circuit 121, a second-stage amplification circuit 123, and a bias sub-circuit 122. The first-stage amplification circuit 121 includes a first amplification sub-circuit 1211 and a second amplification sub-circuit 1212. Each transistor in the first amplification sub-circuit 1211 is a Thick OX MOS, and each transistor in the second amplification sub-circuit 1212 is a Thin OX MOS. Through the control of the first amplification sub-circuit enabling signal ThickEn, the second amplification sub-circuit enabling signal ThinEn, and the second-stage gain enabling signal 2stgEN, the mode of a first-stage amplification+the amplification circuit 12 with Thick OX MOS, the mode of a second-stage amplification+the amplification circuit 12 with Thin OX MOS, the mode of a first-stage amplification+the amplification circuit 12 with Thin OX MOS, and the mode of a second-stage amplification+the amplification circuit 12 with Thin OX MOS can be implemented. Therefore, different working modes and working parameters of the amplification circuit 12 are selected under various working conditions.

Although the embodiment of the present disclosure takes each transistor in the first amplification sub-circuit 1211 being the Thick OX MOS, and each transistor in the second amplification sub-circuit 1212 being the Thin OX MOS for example, in other embodiments, each transistor in the first amplification sub-circuit 1211 may be set as the Thin OX MOS, and each transistor in the second amplification sub-circuit 1212 may be set as the Thick OX MOS, or only the first amplification sub-circuit 1211 may be set.

According to a second aspect of the present disclosure, a chip is provided. The chip includes a bandgap reference circuit as in any one embodiment.

It should be noted that although several circuits or sub-circuits of the apparatus for action execution are mentioned in the above detailed description, this division is not mandatory. Actually, according to embodiments of the present disclosure, the features and functions of the two or more circuits or sub-circuits described above may be embodied in one circuit or sub-circuit. Conversely, the features and functions of one circuit or sub-circuit described above may be further divided into a plurality of circuits or sub-circuits to be embodied.

After considering the description and practicing the invention disclosed herein, it is easy for those skilled in the art to think of other embodiments of the disclosure. The present disclosure is intended to cover any variations, uses, or adaptations of the present disclosure that follow the general principles of the present disclosure and include common sense or conventional techniques in the art that are not disclosed in the present disclosure. The description and embodiments are to be considered exemplary only and the true scope and concept of the present disclosure is indicated by the claims.

In a bandgap reference circuit provided by the embodiment of the present disclosure, a feedback transistor connected to the first power supply is set between the output terminal of the amplification circuit and the input terminal of the reference setting circuit, thus a current related to the output signal of the amplification circuit can be supplied to the reference setting circuit through the first power supply, instead of directly supplying the current to the reference setting circuit through the output terminal of the amplification circuit, thereby greater current can be provided to the reference setting circuit and further the current driving capability of the bandgap reference circuit is improved.

What is claimed is:

1. A bandgap reference circuit, comprising:

a feedback transistor, wherein a source of the feedback transistor is configured to connect to a first power supply and a drain of the feedback transistor is configured to connect to a first node;

a reference setting circuit comprising a first bridge arm and a second bridge arm which are connected in parallel, wherein the first bridge arm comprises a first resistance sub-circuit and a first voltage adjustment sub-circuit which are sequentially connected in series, the second bridge arm comprises a second resistance sub-circuit, a third resistance sub-circuit and a second voltage adjustment sub-circuit which are sequentially connected in series, both the first resistance sub-circuit and the second resistance sub-circuit are connected to the first node, a resistance value of the first resistance sub-circuit is equal to a resistance value of the second resistance sub-circuit, and both the first voltage adjustment sub-circuit and the second voltage adjustment sub-circuit are connected to a ground;

an amplification circuit, wherein an inverting input terminal of the amplification circuit is connected to the first bridge arm, a non-inverting input terminal of the amplification circuit is connected to the second bridge arm, and an output terminal of the amplification circuit is connected to a gate of the feedback transistor; and an output transistor, wherein a gate of the output transistor is connected to an output terminal of the amplification circuit, a source of the output transistor is connected to the first power supply, and a drain of the output transistor is taken as an output terminal of the bandgap reference circuit, wherein the amplification circuit comprises a first-stage amplification circuit and a bias sub-circuit, the bias sub-circuit comprises a first-stage bias transistor, a first terminal of the first-stage amplification circuit is configured to connect to the first power supply, a second terminal of the first-stage amplification circuit is configured to connect to a drain of the first-stage bias transistor in the bias sub-circuit, and the first-stage amplification circuit comprises:

a first P-type transistor, wherein a source of the first P-type transistor is connected to the first power supply, and both a gate of the first P-type transistor and a drain of the first P-type transistor are connected to a second node;

a second P-type transistor, wherein a source of the second P-type transistor is connected to the first power supply, a gate of the second P-type transistor is connected to the second node, and a drain of the second P-type transistor is connected to a third node; and a first amplification sub-circuit, comprising:

a first N-type transistor, wherein a gate of the first N-type transistor is connected to the non-inverting input terminal of the amplification circuit, a source of the first N-type transistor is electrically connected to the drain of the first-stage bias transistor in the bias sub-circuit, and a drain of the first N-type transistor is connected to a fourth node, and the fourth node is electrically connected to the second node; and a second N-type transistor, wherein a gate of the second N-type transistor is connected to the inverting input terminal of the amplification circuit, a source of the second N-type transistor is electrically connected to the drain of the first-stage bias transistor in the bias sub-circuit, a drain of the second N-type transistor is connected to a fifth node, and the fifth node is electrically connected to the third node;

wherein a gate of the first-stage bias transistor is configured to receive a bias signal, and a source of the first-stage bias transistor is connected to the ground, wherein the first amplification sub-circuit further comprises:

a third N-type transistor, wherein a gate of the third N-type transistor is connected to the second resistance sub-circuit, a source of the third N-type transistor is connected to the fourth node, and a drain of the third N-type transistor is connected to the second node; and a fourth N-type transistor, wherein a gate of the fourth N-type transistor is connected to the first resistance sub-circuit, a source of the fourth N-type transistor is connected to the fifth node, and a drain of the fourth N-type transistor is connected to the third node;

wherein a resistance between the gate of the third N-type transistor and the first node is equal to a resistance between the gate of the fourth N-type transistor and the first node, and a resistance between the gate of the third N-type transistor and the first node is less than a resistance between the gate of the first N-type transistor and the first node.

2. The bandgap reference circuit of claim 1, wherein the first voltage adjustment sub-circuit comprises a first PNP triode, an emitter of the first PNP triode is connected to the first resistance sub-circuit, and both a base and a collector of the first PNP triode are connected to the ground, the second voltage adjustment sub-circuit comprises a plurality of second PNP triodes connected in parallel, an emitter of each second PNP triode is connected to the third resistance sub-circuit, and a base and a collector of each second PNP triode are connected to the ground.

3. The bandgap reference circuit of claim 1, wherein both the first resistance sub-circuit and the second resistance sub-circuit comprise a plurality of resistances connected in series, wherein the inverting input terminal of the amplification circuit is connected to a connection node of two resistances in the first resistance sub-circuit, the non-inverting input terminal of the amplification circuit is connected to a connection node of two resistances in the second resistance sub-circuit, and a resistance between the inverting input terminal and the first node is equal to a resistance between the non-inverting input terminal and the first node.

4. The bandgap reference circuit of claim 3, wherein the first resistance sub-circuit comprises a first adjustable resistance, the second resistance sub-circuit comprises a second adjustable resistance, a resistance value of the first adjustable resistance is equal to a resistance value of the second adjustable resistance, and a resistance between an terminal of the first adjustable resistance away from the first node and the first node is equal to a resistance between an terminal of the second adjustable resistance away from the first node and the first node.

5. The bandgap reference circuit of claim 1, wherein each of the transistors in the first amplification sub-circuit is a Thick OX MOS, and the first-stage amplification circuit further comprises:

a second amplification sub-circuit, wherein the second amplification sub-circuit is connected in parallel with the first amplification sub-circuit, a circuit structure and an input signal of the second amplification sub-circuit is same with a circuit structure and an input signal of the first amplification sub-circuit, and the second amplification sub-circuit is configured to output a second amplification signal through the third node according to input signals of the non-inverting input terminal and the inverting input terminal, and each of transistors in the second amplification sub-circuit is a Thin OX MOS; and a control circuit, configured to control that there is one, and only one, of the first amplification sub-circuit and the second amplification sub-circuit is enabled at a same time.

6. The bandgap reference circuit of claim 1, wherein the bias sub-circuit comprises a second-stage bias transistor, and the amplification circuit further comprises:

a second-stage amplification circuit, wherein an input terminal of the second-stage amplification circuit is connected to the first-stage amplification sub-circuit, a first terminal of the second-stage amplification circuit is connected to the first power supply, and the second terminal of the second-stage amplification circuit is connected to a drain of the second-stage amplification circuit of the second-stage bias transistor in the bias sub-circuit, and the second-stage amplification circuit is configured for a second time of amplification of an output signal of the first-stage amplification sub-circuit, a gate of the second-stage bias transistor is configured to receive the bias signal, and a source of the second-stage bias transistor is connected to the ground.

7. The bandgap reference circuit of claim 6, wherein the second-stage amplification circuit comprises:

a second-stage amplification transistor, wherein a gate of the second-stage amplification transistor is connected to the third node, a source of the second-stage amplification transistor is connected to the first power supply, and a drain of the second-stage amplification transistor is connected to a sixth node;

a first switch transistor, wherein the first switch transistor is a P-type transistor, a first terminal of the first switch transistor is connected to the sixth node, a second terminal of the first switch transistor is connected to the output terminal of the amplification circuit, and a control terminal of the first switch transistor is connected to an inverting signal of a second-stage gain enabling signal;

a second switch transistor, wherein the second switch transistor is a P-type transistor, a first terminal of the second switch transistor is connected to the third node, a second terminal of the second switch transistor is connected to the output terminal of the amplification circuit, and a control terminal of the second switch transistor is connected to the second-stage gain enabling signal; and a third switch transistor, wherein the third switch transistor is an N-type transistor, a first terminal of the third switch transistor is connected to the output terminal of the amplification circuit, a control terminal of the third switch transistor is connected to the second-stage gain enabling signal, and a second terminal of the third switch transistor is connected to the drain of the second-stage bias transistor.

8. The bandgap reference circuit of claim 7, wherein the second-stage amplification transistor is a P-type transistor, and the bandgap reference circuit further comprises:

an input signal exchange sub-circuit, wherein the input signal exchange sub-circuit is connected between the non-inverting input terminal and the inverting input terminal of the amplification circuit and the first bridge arm and the second bridge arm, the input signal exchange sub-circuit is configured to control the inverting input terminal of the amplification circuit to connect the first bridge arm and the non-inverting input terminal of the amplification circuit to connect the second bridge arm when the second-stage gain enabling signal is dormant, or, control an input signal of the non-inverting input terminal of the amplification circuit to exchange with an input signal of the inverting input terminal of the amplification circuit when the second-stage gain enabling signal is active.

9. The bandgap reference circuit of claim 8, wherein, when the first amplification sub-circuit comprises the third N-type transistor and the fourth N-type transistor, the bandgap reference circuit further comprises:

a gain control exchange sub-circuit, wherein the gain control exchange sub-circuit is connected between the gate of the third N-type transistor and the gate of the fourth N-type transistor and the first resistance sub-circuit and the second resistance sub-circuit, the gain control exchange sub-circuit is configured to control the gate of the third N-type transistor to connect to the second resistance sub-circuit and the gate of the fourth N-type transistor to connect to the first resistance sub-circuit when the second-stage gain enabling signal is dormant, or, control a connection point of the gate of the third N-type transistor to exchange with a connection point of the gate of the fourth N-type transistor when the second-stage gain enabling signal is active.

10. The bandgap reference circuit of claim 7, wherein the input signal exchange sub-circuit comprises:

a fourth switch transistor, wherein the fourth switch transistor is an N-type transistor, a first terminal of the fourth switch transistor is connected to the non-inverting input terminal, the second terminal of the fourth switch transistor is connected to the second bridge arm, and the gate of the fourth switch transistor is connected to the inverting signal of a second-stage gain enabling signal;

a fifth switch transistor, wherein the fifth switch transistor is an N-type transistor, a first terminal of the fifth switch transistor is connected to the non-inverting input terminal, a second terminal of the fifth switch transistor is connected to the first bridge arm, and a gate of the fifth switch transistor is connected to the second-stage gain enabling signal;

a sixth switch transistor, wherein the sixth switch transistor is an N-type transistor, a first terminal of the sixth switch transistor is connected to the inverting input terminal, a second terminal of the sixth switch transistor is connected to the second bridge arm, and a gate of the sixth switch transistor is connected to the second-stage gain enabling signal; and a seventh switch transistor, wherein the seventh switch transistor is an N-type transistor, a first terminal of the seventh switch transistor is connected to the inverting input terminal, a second terminal of the seventh switch transistor is connected to the first bridge arm, and a gate of the seventh switch transistor is connected to the inverting signal of a second-stage gain enabling signal.

11. The bandgap reference circuit of claim 9, wherein the gain control exchange sub-circuit comprises:

an eighth switch transistor, wherein the eighth switch transistor is an N-type transistor, a first terminal of the eighth switch transistor is connected to the gate of the third N-type transistor, a second terminal of the eighth switch transistor is connected to the second resistance sub-circuit, and a gate of the eighth switch transistor is connected to the inverting signal of the second-stage gain enabling signal;

a ninth switch transistor, wherein the ninth switch transistor is an N-type transistor, a first terminal of the ninth switch transistor is connected to the gate of the third N-type transistor, a second terminal of the ninth switch transistor is connected to the first resistance sub-circuit, and a gate of the ninth switch transistor is connected to the second-stage gain enabling signal;

a tenth switch transistor, wherein the tenth switch transistor is an N-type transistor, a first terminal of the tenth switch transistor is connected to the gate of the fourth N-type transistor, a second terminal of the tenth switch transistor is connected to the second resistance sub-circuit, and a gate of the tenth switch transistor is connected to the second-stage gain enabling signal; and an eleventh switch transistor, wherein the eleventh switch transistor is an N-type transistor, a first terminal of the eleventh switch transistor is connected to the gate of the fourth N-type transistor, a second terminal of the eleventh switch transistor is connected to the first resistance sub-circuit, and a gate of the eleventh switch transistor is connected to the inverting signal of the second-stage gain enabling signal.

12. The bandgap reference circuit of claim 1, wherein the bias sub-circuit further comprises:

a bias resistance sub-circuit, wherein a first terminal of the bias resistance sub-circuit is connected to the first power supply, a second terminal of the bias resistance sub-circuit is connected to a bias node, the bias node is configured to transmit the bias signal, and the bias resistance sub-circuit comprises an adjustable resistance; and a self-bias transistor, wherein both a gate of the self-bias transistor and a drain of the self-bias transistor are connected to the bias node, and a source of the self-bias transistor is connected to the ground.

13. A chip comprising a bandgap reference circuit, wherein the bandgap reference circuit comprises:

a feedback transistor, wherein a source of the feedback transistor is configured to connect to a first power supply and a drain of the feedback transistor is configured to connect to a first node;

a reference setting circuit comprising a first bridge arm and a second bridge arm which are connected in parallel, wherein the first bridge arm comprises a first resistance sub-circuit and a first voltage adjustment sub-circuit which are sequentially connected in series, the second bridge arm comprises a second resistance sub-circuit, a third resistance sub-circuit and a second voltage adjustment sub-circuit which are sequentially connected in series, both the first resistance sub-circuit and the second resistance sub-circuit are connected to the first node, a resistance value of the first resistance sub-circuit is equal to a resistance value of the second resistance sub-circuit, and both the first voltage adjustment sub-circuit and the second voltage adjustment sub-circuit are connected to a ground;

an amplification circuit, wherein an inverting input terminal of the amplification circuit is connected to the first bridge arm, a non-inverting input terminal of the amplification circuit is connected to the second bridge arm, and an output terminal of the amplification circuit is connected to a gate of the feedback transistor; and an output transistor, wherein a gate of the output transistor is connected to an output terminal of the amplification circuit, a source of the output transistor is connected to the first power supply, and a drain of the output transistor is taken as an output terminal of the bandgap reference circuit, wherein the amplification circuit comprises a first-stage amplification circuit and a bias sub-circuit, the bias sub-circuit comprises a first-stage bias transistor, a first terminal of the first-stage amplification circuit is configured to connect to the first power supply, a second terminal of the first-stage amplification circuit is configured to connect to a drain of the first-stage bias transistor in the bias sub-circuit, and the first-stage amplification circuit comprises:

a first P-type transistor, wherein a source of the first P-type transistor is connected to the first power supply, and both a gate of the first P-type transistor and a drain of the first P-type transistor are connected to a second node;

a second P-type transistor, wherein a source of the second P-type transistor is connected to the first power supply, a gate of the second P-type transistor is connected to the second node, and a drain of the second P-type transistor is connected to a third node; and a first amplification sub-circuit, comprising:

a first N-type transistor, wherein a gate of the first N-type transistor is connected to the non-inverting input terminal of the amplification circuit, a source of the first N-type transistor is electrically connected to the drain of the first-stage bias transistor in the bias sub-circuit, and a drain of the first N-type transistor is connected to a fourth node, and the fourth node is electrically connected to the second node; and a second N-type transistor, wherein a gate of the second N-type transistor is connected to the inverting input terminal of the amplification circuit, a source of the second N-type transistor is electrically connected to the drain of the first-stage bias transistor in the bias sub-circuit, a drain of the second N-type transistor is connected to a fifth node, and the fifth node is electrically connected to the third node:

wherein a gate of the first-stage bias transistor is configured to receive a bias signal, and a source of the first-stage bias transistor is connected to the ground, wherein the first amplification sub-circuit further comprises:

a third N-type transistor, wherein a gate of the third N-type transistor is connected to the second resistance sub-circuit, a source of the third N-type transistor is connected to the fourth node, and a drain of the third N-type transistor is connected to the second node; and a fourth N-type transistor, wherein a gate of the fourth N-type transistor is connected to the first resistance sub-circuit, a source of the fourth N-type transistor is connected to the fifth node, and a drain of the fourth N-type transistor is connected to the third node;

wherein a resistance between the gate of the third N-type transistor and the first node is equal to a resistance between the gate of the fourth N-type transistor and the first node, and a resistance between the gate of the third N-type transistor and the first node is less than a resistance between the gate of the first N-type transistor and the first node.

14. The chip of claim 13, wherein the first voltage adjustment sub-circuit comprises a first PNP triode, an emitter of the first PNP triode is connected to the first resistance sub-circuit, and both a base and a collector of the first PNP triode are connected to the ground, the second voltage adjustment sub-circuit comprises a plurality of second PNP triodes connected in parallel, an emitter of each second PNP triode is connected to the third resistance sub-circuit, and a base and a collector of each second PNP triode are connected to the ground.

15. The chip of claim 13, wherein both the first resistance sub-circuit and the second resistance sub-circuit comprise a plurality of resistances connected in series, wherein the inverting input terminal of the amplification circuit is connected to a connection node of two resistances in the first resistance sub-circuit, the non-inverting input terminal of the amplification circuit is connected to a connection node of two resistances in the second resistance sub-circuit, and a resistance between the inverting input terminal and the first node is equal to a resistance between the non-inverting input terminal and the first node.

16. The chip of claim 15, wherein the first resistance sub-circuit comprises a first adjustable resistance, the second resistance sub-circuit comprises a second adjustable resistance, a resistance value of the first adjustable resistance is equal to a resistance value of the second adjustable resistance, and a resistance between an terminal of the first adjustable resistance away from the first node and the first node is equal to a resistance between an terminal of the second adjustable resistance away from the first node and the first node.

* * * * *